United States Patent [19]

Janssen et al.

[11] 4,455,219

[45] Jun. 19, 1984

[54] METHOD OF REDUCING COKE YIELD

[75] Inventors: Harry R. Janssen; Gary L. Poffenbarger, both of Ponca City, Okla.

[73] Assignee: Conoco Inc., Ponca City, Okla.

[21] Appl. No.: 464,181

[22] Filed: Feb. 9, 1983

Related U.S. Application Data

[63] Continuation-in-part of Ser. No. 353,671, Mar. 1, 1982, abandoned.

[51] Int. Cl.[3] ..... C10G 9/14
[52] U.S. Cl. ..... 208/131
[58] Field of Search ..... 208/50, 131

[56] References Cited

U.S. PATENT DOCUMENTS

| | | | |
|---|---|---|---|
| 2,315,192 | 3/1943 | Egloff | 208/50 |
| 2,568,967 | 9/1951 | Offutt et al. | 208/131 |
| 3,087,840 | 8/1972 | Sze et al. | 208/50 X |
| 3,375,188 | 3/1968 | Bloomer | 208/131 X |
| 3,709,206 | 10/1973 | Folkins | 208/131 X |
| 3,956,101 | 5/1976 | Hara et al. | 208/131 X |
| 4,049,538 | 9/1977 | Hayashi et al. | 208/131 X |
| 4,108,798 | 8/1978 | Sze et al. | 208/50 X |
| 4,178,229 | 12/1979 | McConaghy et al. | 208/50 |
| 4,213,846 | 7/1980 | Sooter et al. | 208/50 |

*Primary Examiner*—Delbert E. Gantz
*Assistant Examiner*—Glenn A. Caldarola
*Attorney, Agent, or Firm*—Richard W. Collins

[57] ABSTRACT

The coke yield from a delayed coker is minimized by substituting a lower boiling range material for a part of the conventional recycle.

34 Claims, 1 Drawing Figure

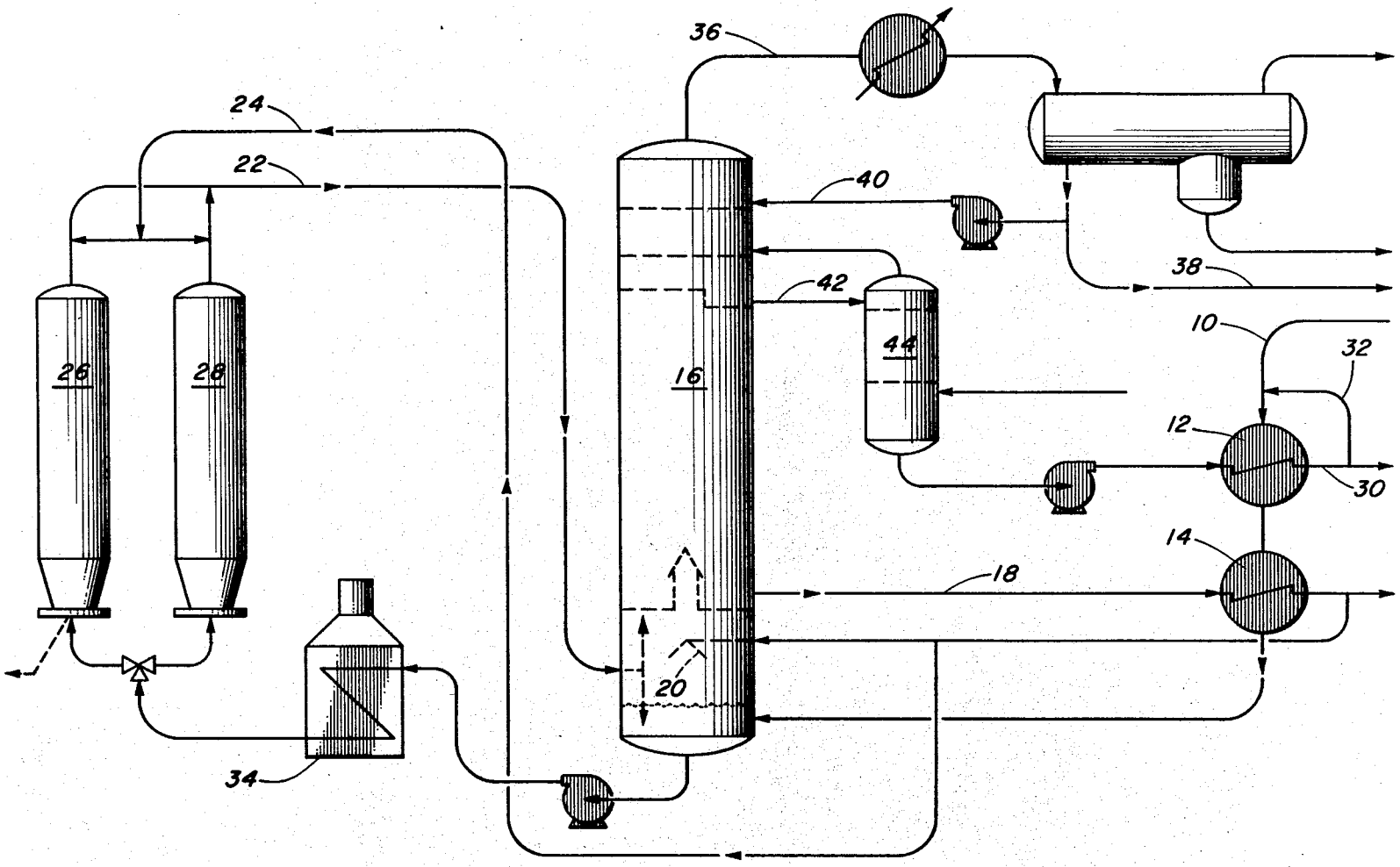
10
12
14
16
18
20
22
24
26
28
30
32
34
36
38
40
42
44

METHOD OF REDUCING COKE YIELD

RELATED APPLICATION

This application is a continuation-in-part of co-pending application Ser. No. 353,671, filed Mar. 1, 1982, now abandoned.

BACKGROUND OF THE INVENTION

1. Field of the Invention

This invention relates to delayed coking, and more particularly to a method of minimizing the coke yield from a delayed coking operation.

2. The Prior Art

Delayed coking has been practiced for many years. The process broadly involves thermal decomposition of heavy liquid hydrocarbons to produce gas, liquid streams of various boiling ranges, and coke.

Coking of resids from heavy, sour (high sulfur) crude oils is carried out primarily as a means of disposing of low value resids by converting part of the resids to more valuable liquid and gas products. The resulting coke is generally treated as a low value by-product.

The use of heavy crude oils having high metals and sulfur content is increasing in many refineries, and delayed coking operations are of increasing importance to refiners. The increasing concern for minimizing air pollution is a further incentive for treating resids in a delayed coker, as the coker produces gas and liquids having sulfur in a form that can be relatively easily removed.

In the basic delayed coking process as practiced today, feedstock is introduced to a fractionator, and the fractionator bottoms including recycle material are heated to coking temperature in a coker furnace. The hot feed then goes to a coke drum maintained at coking conditions of temperature and pressure where the feed decomposes to form coke and volatile components. The volatile components are recovered and returned to the fractionator. When the coke drum is full of solid coke, the feed is switched to another drum, and the full drum is cooled and emptied by conventional methods.

Some coking operations involve passing vacuum resid directly from a crude oil vacuum distillation unit to a coker furnace with no intermediate storage. An advantage of this method is that the coker feed is always at a readily pumpable temperature, and heated storage or dilution is not required. A disadvantage is that if either the vacuum distillation unit or the coker unit is shut down for any reason, then the other unit must be shut down, or other steps must be taken until the shut down unit is back on stream.

Other coking operations utilize heated or insulated storage tanks to maintain resid at a pumpable temperature. This is probably the preferred design, as it avoids the need for dilution of resid to keep it pumpable, and it provides flexibility if either the distillation unit or the coker unit is temporarily shut down.

Still other coking operations utilize unheated storage of resid. A serious drawback to unheated resid storage is that heavy vacuum resids, such as those having an API gravity of less than about 10, must be diluted with "cutter stock" before they have cooled much below about 300° F., and certainly before they are cooled to 180° F. or so, or else they become so viscous as to be essentially unpumpable. Normally in such feedstock cutting operations a diluent or cutter stock is added to the feed before it is cooled below about 300° F. and before it is placed in an unheated storage tank. In this way, the resid and diluent are well mixed before storage, and can still be pumped out of the storage tank. The major deficiency of this method is that it is energy inefficient, as the resid and cutter stock must be reheated from storage temperature. Also, the volume of diluent required is quite large, requiring larger tanks, pumps, lines, etc.

The present invention is not particularly applicable to those coking operations where diluent is added to resid to maintain its pumpability during storage before it is passed to storage. The invention is primarily beneficial for those coking operations where resid is passed directly to the coker unit from the distillation unit, and to those coking operations where resid is stored at elevated temperature.

The invention is not limited to coking operations where petroleum resid is the feedstock, but is applicable to other coker feedstocks such as coal liquifaction products or other low gravity, high viscosity hydrocarbon streams which might be amenable to delayed coking to produce fuel grade coke.

The delayed coking process is discussed in an article by Kasch et al entitled "Delayed Coking," *The Oil and Gas Journal*, Jan. 2, 1956, pp. 89–90.

A delayed coking process for coal tar pitches illustrating use of heavy gas oil recycle is shown in U.S. Pat. No. 3,563,884 to Bloomer et al.

A discussion of early delayed coking processes appears in an article by Armistead entitled "The Coking of Hydrocarbon Oils," *The Oil and Gas Journal*, Mar. 16, 1946, pp 103–111.

U.S. Pat. No. 4,213,846 discloses a delayed coking process for making premium coke in which a recycle stream is hydrotreated.

U.S. Pat. No. 4,216,074 describes a dual coking process of coal liquefaction products wherein condensed liquids from the coke vapor stream and heavy gas oil reflux are used as recycle liquid to the coke drums.

U.S. Pat. No. 4,177,133 describes a coking process in which the heavier material from the coke drum vapor line is combined as recycle with fresh coker feed and then passed to a coke drum.

Many additional references, of which U.S. Pat. Nos. 2,380,713; 3,116,231 and 3,472,761 are exemplary, disclose variations and modifications of the basic delayed coking process.

SUMMARY OF THE INVENTION

According to the present invention, the conventional delayed coking process is modified by minimizing the amount of normal heavy recycle used, and by adding a lower boiling range stream from the coker fractionator or from some other source as a part, preferably a major part, of the recycle material.

BRIEF DESCRIPTION OF THE DRAWINGS

The FIGURE is a schematic flow diagram illustrating the process of the invention.

DESCRIPTION OF THE PREFERRED EMBODIMENT

In the design and operation of a delayed coker, the furnace is the most critical piece of equipment. The furnace must be able to heat the feedstock to coking temperatures without causing coke formation on the furnace tubes. When the furnace tubes become coked, the operation must be shut down and the furnace cleaned out. In some cases, steam is injected into the furnace tubes to increase the tube velocity and turbulence as a means of retarding coke deposits. However, steam injection is not energy efficient and can adversely affect coke quality, and therefore is preferably minimized. It is, however, important to have steam injection capability to blow out the furnace tubes in the event of feed pump failure. Properly designed and operated coker furnaces can now operate for many months without being cleaned.

The present invention is applicable in those cases where the coker feed, without addition of diluent, is pumpable from the time it leaves the vacuum distillation tower or other source unit until it is fed to the coker unit. As used herein, the term "pumpable coker feed" refers to a heavy hydrocarbon liquid stream which from the time it leaves its source unit, which generally will be a vacuum distillation tower, until it reaches the coker unit, and including any intermediate storage time, by virtue of its composition or its temperature or a combination thereof always has a viscosity such that it can be readily pumped to and from these units including storage units without the necessity of adding diluent to maintain pumpability.

It is conventional to recycle from about 0.1 to about 0.7 volumes of heavy recycle material for each volume of fresh coker feed. This recycle material improves the coker furnace operation and also provides a solvent effect which aids in preventing coke deposits on the furnace tubes. As will be discussed in detail later, conventional recycle material is a combination of condensed coke drum vapors and heavy coker gas oil, generally having a boiling range of from about 750° to 950° F. or higher, although small amounts of components boiling below 750° F. may be present.

Some coker feedstocks, and particularly those from heavy crude oils, require the use of higher than normal recycle rates to prevent furnace tube coking. A resid from a good quality crude oil might require from 0.1 to 0.3 volumes recycle per volume of fresh feed, and a resid from a heavy crude might require from 0.3 to 0.7 volumes recycle. The use of these higher recycle rates is undesirable in that it affects the production capacity of the coker, and more importantly, it increases the coke yield measured as a percentage of the fresh feed. The increase in the coke yield from using high recycle rates of heavy material apparently is a result of coke formation from the recycle material itself. This is undesirable because the coke is often the least valuable product from the coking operation.

A coker fractionator produces several products including gases, a gasoline boiling range product, one or more distillate streams, and a heavy coker gas oil stream.

The essence of the present invention involves adding a material having a boiling range which at least in part is lower than the boiling range of the normal heavy recycle as a portion of the recycle.

The preferred embodiment of the invention will be first described generally with reference to the drawing.

Fresh coker feedstock from line 10 passes through heat exchangers 12 and 14 where it is preheated. The preheated feed is then introduced to the bottom of coker fractionator 16. Heavy coker gas oil is withdrawn from fractionator 16 via line 18, and a portion of the gas oil is returned to a spray nozzle 20 where it is utilized to knock down entrained material and condense the heavier components of the vapor entering the coke drum from line 22.

A small amount of coker heavy gas oil is circulated via line 24 to quench the vapors from coke drums 26 and 28. This prevents coke deposition in the vapor lines. Other liquids may be used to quench these vapors, and in some cases the hottest part of the line may be uninsulated to effect quenching.

According to the preferred embodiment of the invention, the combined amount of heavy gas oil used in spray nozzle 20 and line 24 is held to a minimum amount consistent with good fractionator operation, such as an amount sufficient to generate about 5 to about 15 parts (by volume) heavy recycle for each 100 parts of fresh coker feed. The minimum amount of material required to accomplish these objects will depend on the particular feedstock and coking conditions, but can be readily determined for a given set of conditions by those skilled in the art. However, this minimum amount of recycle material in many cases is insufficient to effectively prevent deposition of coke on the furnace tubes, and in accordance with the preferred embodiment of the invention an intermediate distillate side stream is withdrawn from distillate product line 30 via line 32 and combined with fresh feed stock in line 10. The amount of intermediate distillate used may be any amount which is effective in lowering the coke yield compared to the coke yield when heavy recycle with no intermediate distillate is used. Preferably, the amount of distillate used is sufficient to significantly lower the coke yield. This amount is generally from about 5 to about 50 parts by volume of distillate per 100 parts of fresh feed, and preferably about 15 to about 30 parts for most cases.

The invention is applicable to delayed cokers in general, and is particularly useful when resids having an API gravity of less than about 10 are coked. Typical feedstocks to which the invention is especially useful include vacuum resids from low gravity crude oils, and particularly from high sulfur and/or high metals crude oils. Resids having an API gravity of less than 10 and a sulfur content of more than 2 percent by weight are particularly appropriate.

The combined fresh feed, heavy recycle and distillate recycle are charged to coker furnace 34 where they are heated to coking temperature and charged to one coke drum while the other drum is being cooled and decoked by conventional methods. Vapors from the drum being filled are quenched as described previously and returned to fractionator 16 via line 22. These vapors are fractionated to produce products including coker wet gas through line 36 and coker gasoline through line 38. Part of the coker gasoline is refluxed to the top of fractionator 16 via line 40.

An intermediate distillate stream is withdrawn via line 42 and steam stripped in stripper 44, and a stream from stripper 44 is returned to fractionator 16.

A portion of the distillate product from stripper 44 is withdrawn from distillate product line 30 via distillate recycle line 32 and combined with fresh feed as previously described.

The amount of distillate added as recycle will vary depending on many process variables including fresh feed composition, amount of heavy recycle, furnace design, furnace operating conditions, etc. For feedstocks having a high tendency to deposit coke on furnace tubes, it is preferred that the amount of distillate recycle added be from about 1.0 to about 5.0 times the amount of heavy recycle. The amount of recycle added preferably is at least enough to prevent coke deposition in the furnace tubes. Typically, for resid from a heavy sour crude, the combined recycle will be from about 0.3 to about 0.7 times the volume of fresh feed.

As mentioned previously, a properly designed and operated coker operation utilizes a minimum amount of recycle consistent with proper coker furnace operation. Stated another way, the amount of recycle used is the lowest amount that prevents coke formation in the furnace tubes. This amount varies with the quality of the feedstock. A relatively high gravity resid in a good coker unit might require as little as 0.1 volumes of recycle for each volume of fresh feed, while a poor quality resid having an API gravity of less than 10, and especially such a resid having an API gravity of less than about 5, may require as much as from 0.5 to 0.7 volumes recycle for each volume of fresh feed to prevent coke formation in the furnace tubes.

A discussed above, a certain minimum amount of heavy recycle results from use of heavy gas oil as quench oil in the coker vapor line and/or from heavy gas oil sprayed into the coker fractionator to known down entrained material and heavy components in the coker vapor stream. In order to minimize the coke yield (and maximize the proportion of more valuable gases and liquids) the amount of heavy recycle must be minimized, as the heavy recycle contains coke forming components which, if put back through the coker, contribute to the total coke production.

This invention involves substitution of a lighter distillate hydrocarbon stream for a portion of the heavy recycle material in cases where the total recycle material needed for proper furnace operation is more than the amount resulting from using the minimum amount of heavy gas oil as vapor line quench oil and/or spray oil which provides good coker fractionator operation. The lighter distillate is essentially free of coke forming components, so substitution of lighter distillate for a major portion of heavy recycle (which contains coke forming components) reduces the coke yield measured as a percentage of fresh feed.

The invention is applicable to delayed coking operations generally, and specifically to delayed coking operations where petroleum vacuum resid is passed directly from a distillation unit to a coker unit without intermediate storage of the resid, and to delayed coking operations where petroleum vacuum resid is passed from a distillation unit to a heated or insulated storage tank and subsequently passed to a coker unit without ever having cooled down to a temperature where it would be essentially nonpumpable.

In cases where a "long" resid or a resid from a high gravity crude oil is coked, or where a large amount of diluent or cutter stock is added to a resid to maintain the resid pumpable at storage temperature, the invention is not particularly applicable. In those cases, the amount of recycle needed for good furnace operation is usually not more than the minimum amount inherent in using heavy gas oil as vapor quench and/or in using heavy gas oil in the fractionator as a spray to knock down heavy components from the incoming vapor stream.

Directionally, the object of the invention is to use the lowest amount of total recycle consistent with good furnace operation, and to use the highest proportion of lighter distillate in the total recycle that is consistent with good overall coker operation, recognizing that some minimum amount of the total recycle will be heavy material resulting from use of heavy gas oil as vapor line quench oil and/or fractionator spray oil.

As mentioned previously, while the process is described as a coking operation, the fact is that products other than coke are desired, and it is an object of the invention to produce a minimum coke yield consistent with proper operation and product quality. The substitution of lower boiling distillate material for part of the heavy recycle provides a reduced coke yield, based on fresh feed throughput, compared to the conventional use of heavy material as the source of the entire recycle.

In the operation as described below, it will be appreciated that when heavy gas oil is returned to the fractionator through spray nozzle 20, part of it flashes as it enters the fractionator, and the heavy recycle combining with fresh feed is actually a combination of heavy gas oil which did not flash and condensed coke drum vapors. The fresh feed and distillate recycle entering the bottom of the fractionator from line 10 are considerably cooler than the incoming vapor from line 22, and no appreciable vaporization takes place in the bottom of the fractionator. The feed to furnace 34 thus is comprised of fresh feed, distillate recycle, heavy gas oil which did not flash and condensed coke drum vapor. The condensed coke drum vapor may include some quench oil. The difference in the process of the invention and the prior art is in the addition of a distillate material having a boiling range which at least in part is lower than the boiling range of normal heavy recycle as a part, preferably a major part, of the recycle for the process.

It is not necessary that the lower boiling range material used in place of part of the normal recycle be from the coker fractionator, but in most cases this would be the preferred source. The lower boiling range material has no fixed specification other than that it is a hydrocarbon material having a boiling range which at least in part is lower than the boiling range of the normal heavy recycle. Preferably, it is a high molecular weight intermediate distillate stream from the coker fractionator. In cases where more than one intermediate distillate stream is recovered from the fractionator, the higher boiling distillate stream would preferably be used. Typically, the distillate stream which is used in place of part of the conventional heavy recycle has a boiling range of between about 335° F. and about 850° F., preferably between about 450° and about 750° F., and most preferably between about 510° F. and about 650° F. The normal heavy recycle consists primarily of material boiling above about 750° F.

Expressed another way, the total recycle in accordance with the invention preferably includes a major part of distillate material boiling from about 335° to about 850° F., and more preferably includes a major part of distillate material boiling from about 450° to about 750° F. (most preferably from about 510° to about 650° F.) and a minor part of conventional heavy recycle comprised of heavy gas oil which did not flash and condensed coke drum vapors, the heavy recycle comprising primarily material boiling above about 750° F., and in most cases primarily material boiling above about 850° F. The distillate material preferably is recovered from the coker fractionator, combined with the fresh feed, and introduced to the bottom of the coker fractionator.

EXAMPLE 1

The reduced coke yield provided by the invention is demonstrated in the following simulated example derived from a highly developed coker design program. In this example, two runs were made using identical feedstocks and coking conditions, except in one case conventional heavy recycle (35 parts for each 100 parts fresh feed) was used for all the recycle, and in the other case 10 parts of conventional heavy recycle and 25 parts of a distillate material having a boiling range of from 510° to 650° F. were used for each 100 parts of fresh feed.

In both runs, a feedstock having an API gravity of 5.0, a Conradson carbon content of 20.0 percent by weight, a characterization factor "K" of 11.5 and a sulfur content of 4.0 percent by weight was coked at a pressure of 30 psig and a temperature of 835° F. The product distribution from the two runs is tabulated below.

| Run 1 (Conventional Recycle) | | Run 2 (Distillate Recycle) | |
|---|---|---|---|
| Component | Weight Percent | Component | Weight Percent |
| $H_2S$ | 1.16 | $H_2S$ | 1.16 |
| $H_2$ | 0.08 | $H_2$ | 0.08 |
| $C_1$ | 3.52 | $C_1$ | 3.39 |
| $C_2$ | 1.52 | $C_2$ | 1.36 |
| $C_3$ | 1.90 | $C_3$ | 1.64 |
| $C_4$ | 1.93 | $C_4$ | 1.75 |
| $C_5$-335° F. | 12.49 | $C_5$-335° F. | 11.17 |
| 335-510° F. | 15.44 | 335-510° F. | 14.36 |
| 510-650° F. | 12.89 | 510-660° F. | 11.98 |
| 650° F.+ | 14.58 | 650° F.+ | 20.65 |
| Coke | 34.50 | Coke | 32.45 |

The foregoing example indicates that about a six percent reduction in coke yield (32.45 percent versus 34.50 percent) results when a 510°-650° F. distillate stream is used in a ratio of 25 parts distillate to 10 parts of heavy recycle. Similar results are provided at different operating conditions and with different feedstocks. This reduction in coke yield, over a period of time, results in very significant improvements in the economics of a coking operation. It also provides flexibility of product distribution when market conditions or other factors dictate a minimum amount of coke product.

The foregoing description of the preferred embodiment is intended to be illustrative rather than limiting of the invention, which is defined by the appended claims.

We claim:

1. In a delayed coking process carried out in a coker unit comprised of a coker furnace, a coke drum and a coker fractionator, wherein coker feedstock and recycle material are heated to coking temperature in said furnace and then passed to said coke drum where coke and overhead vapors are formed, wherein said overhead vapors are passed to said fractionator, wherein a portion of said overhead vapors are condensed and combined with said feedstock as heavy recycle, wherein the amount of said overhead vapors condensed is sufficient to provide good fractionator operation and sufficient to provide enough heavy recycle to effectively prevent coke formation on the tubes of said furnace, and wherein the coke yield is higher than is desired, the improvement comprising:

operating with an amount of heavy recycle that is not sufficient to effectively prevent coke formation on the furnace tubes, and adding to said feedstock as additional recycle a distillate hydrocarbon material having a boiling range which is at least in part lower than the boiling range of said heavy recycle, said distillate hydrocarbon material being added in an amount which, when combined with said heavy recycle, is effective to prevent coke formation on the tubes of said furnace, whereby coke formation on the tubes of said furnace is effectively prevented, the yield of liquid products from the process is increased, and the coke yield from the process is decreased.

2. The process of claim 1 wherein said distillate hydrocarbon material is recovered from a coker fractionator, combined with said coker feedstock and fed to the bottom of said coker fractionator.

3. The process of claim 1 wherein said distillate hydrocarbon material has a boiling range between about 335° and about 850° F.

4. The process of claim 1 wherein said distillate hydrocarbon material has a boiling range between 450° and about 750° F.

5. The process of claim 1 wherein said distillate hydrocarbon material has a boiling range between about 510° and about 650° F.

6. The process of claim 1 wherein the amount of said distillate hydrocarbon material added is from about 1.0 to about 5.0 times the amount of heavy recycle used.

7. The process of claim 6 wherein heavy coker gas oil is used to quench coke drum vapors between the coke drum and the fractionator and to condense coke drum vapors and remove entrained material entering said fractionator, and the combined amount of said heavy gas oil used is sufficient to generate from about 5 to about 15 parts of heavy recycle for each 100 parts of fresh coker feed.

8. The process of claim 7 wherein the amount of said distillate hydrocarbon material added is from about 15 to about 30 parts for each 100 parts of fresh coker feed.

9. The process of claim 8 wherein said coker feedstock is a resid having an API gravity of less than 10 and a sulfur content of more than 2.0 percent by weight.

10. In a delayed coking process carried out in a coker unit comprised of a coker furnace, a coke drum and a coker fractionator, wherein coker feedstock and recycle material are heated to coking temperature in said furnace and then passed to said coke drum where coke and overhead vapors are formed, wherein said overhead vapors are passed to said fractionator, wherein a portion of said overhead vapors are condensed and combined with said feedstock as heavy recycle, wherein the amount of said overhead vapors condensed is sufficient to provide good fractionator operation and sufficient to provide enough heavy recycle to effectively prevent coke formation on the tubes of said furnace, and wherein the coke yield is higher than is desired, the improvement comprising:

operating with an amount of heavy recycle that is not sufficient to effectively prevent coke formation on the furnace tubes, said amount of heavy recycle being at least partially generated by contact of said overhead vapors with heavy gas oil which has been previously withdrawn from said fractionator, and adding to said feedstock as additional recycle a distillate hydrocarbon material having a boiling range which is at least in part lower than the boiling range of said heavy recycle, said distillate hydrocarbon material being added in an amount which, when combined with said heavy recycle, is effective to prevent coke formation on the tubes of said furnace, whereby coke formation on the tubes of said furnace is effectively prevented, the yield of liquid products from the process is increased, and the coke yield from the process is decreased.

11. The process of claim 10 wherein said distillate hydrocarbon material is recovered from a coker fractionator, combined with said coker feedstock and fed to the bottom of said coker fractionator.

12. The process of claim 10 wherein said distillate hydrocarbon material has a boiling range between about 335° and about 850° F.

13. The process of claim 10 wherein said distillate hydrocarbon material has a boiling range between about 450° and about 750° F.

14. The process of claim 10 wherein said distillate hydrocarbon material has a boiling range between about 510° and about 650° F.

15. The process of claim 10 wherein the amount of said distillate hydrocarbon material added is from about 1.0 to about 5.0 times the amount of heavy recycle used.

16. The process of claim 15 wherein heavy coker gas oil is used to quench coke drum vapors between the coke and the fractionator and to condense coke drum vapors and remove entrained material entering said fractionator, and the combined amount of said heavy gas oil used is sufficient to generate from about 5 to about 15 parts of heavy recycle for each 100 parts of fresh coker feed.

17. The process of claim 16 wherein the amount of said distillate hydrocarbon material added is from about 15 to about 30 parts for each 100 parts of fresh coker feed.

18. The process of claim 17 wherein said coker feedstock is a resid having an API gravity of less than 10 and a sulfur content of more than 2.0 percent by weight.

19. In a delayed coking process carried out in a coker unit comprised of a coker furnace, a coke drum and a coker fractionator, wherein coker feedstock and recycle material are heated to coking temperature in said furnace and then passed to said coke drum where coke and overhead vapors are formed, wherein said overhead vapors are passed to said fractionator, wherein a portion of said overhead vapors are condensed and combined with said feedstock as heavy recycle, wherein the amount of said overhead vapors condensed is sufficient to provide good fractionator operation and sufficient to provide enough heavy recycle to effectively prevent coke formation on the tubes of said furnace, and wherein the coke yield is higher than is desired, the improvement comprising:

operating with an amount of heavy recycle that is not sufficient to effectively prevent coke formation on the furnace tubes, and adding to said feedstock as additional recycle a distillate hydrocarbon material recovered from said fractionator above the heavy gas oil draw, said distillate hydrocarbon material being added in an amount which, when combined with said heavy recycle, is effective to prevent coke formation on the tubes of said furnace, whereby coke formation on the tubes of said furnace is effectively prevented, the yield of liquid products from the process is increased, and the coke yield from the process is decreased.

20. The process of claim 19 wherein said distillate hydrocarbon material has a boiling range between about 335° and about 850° F.

21. The process of claim 19 wherein said distillate hydrocarbon material has a boiling range between about 450° and about 750° F.

22. The process of claim 19 wherein said distillate hydrocarbon material has a boiling range between about 510° and about 650° F.

23. The process of claim 19 wherein the amount of said distillate hydrocarbon material added is from about 1.0 to about 5.0 times the amount of heavy recycle used.

24. The process of claim 23 wherein heavy coker gas oil is used to quench coke drum vapors between the coke drum and the fractionator and to condense coke drum vapors and remove entrained material entering said fractionator, and the combined amount of said heavy gas oil used is sufficient to generate from about 5 to about 15 parts of heavy recycle for each 100 parts of fresh coker feed.

25. The process of claim 24 wherein the amount of said distillate hydrocarbon material added is from about 15 to about 30 parts for each 100 parts of fresh coker feed.

26. The process of claim 25 wherein said coker feedstock is a resid having an API gravity of less than 10 and a sulfur content of more than 2.0 percent by weight.

27. In a delayed coking process carried out in a coker unit comprised of a coker furnace, a coke drum and a coker fractionator, wherein coker feedstock, which from the time it leaves its source unit until it reaches said coker unit, including any intermediate storage time, by virtue of its composition or its temperature or a combination thereof always has a viscosity such that it can be readily pumped without the necessity of adding diluent to maintain pumpability, is combined with recycle material and heated to coking temperature in said furnace and then passed to said coke drum where coke and overhead vapors are formed, wherein said overhead vapors are passed to said fractionator, wherein a portion of said overhead vapors are condensed and combined with said feedstock as heavy recycle, wherein the amount of said overhead vapors condensed is sufficient to provide good fractionator operation and sufficient to provide enough heavy recycle to effectively prevent coke formation on the tubes of said furnace, and wherein the coke yield is higher than is desired, the improvement comprising:

operating with an amount of heavy recycle that is not sufficient to effectively prevent coke formation on the furnace tubes, said amount of heavy recycle being at least partially generated by contact of said overhead vapors with heavy gas oil which has been previously withdrawn from said fractionator, and adding to said feedstock as additional recycle a distillate hydrocarbon material recovered from said fractionator above the heavy gas oil draw, said distillate hydrocarbon material being added in an amount which, when combined with said heavy recycle, is effective to prevent coke formation on the tubes of said furnace, whereby coke formation on the tubes of said furnace is effectively prevented, the yield of liquid products from the process is increased, and the coke yield from the process is decreased.

28. The process of claim 27 wherein said distillate hydrocarbon material has a boiling range between about 335° and about 850° F.

29. The process of claim 27 wherein said distillate hydrocarbon material has a boiling range between about 450° and about 750° F.

30. The process of claim 27 wherein said distillate hydrocarbon material has a boiling range between about 510° and about 650° F.

31. The process of claim 27 wherein the amount of said distillate hydrocarbon material added is from about 1.0 to about 5.0 times the amount of heavy recycle used.

32. The process of claim 31 wherein heavy coker gas oil is used to quench coke drum vapors between the coke drum and the fractionator and to condense coke drum vapors and remove entrained material entering said fractionator, and the combined amount of said heavy gas oil used is sufficient to generate from about 5 to about 15 parts of heavy recycle for each 100 parts of fresh coker feed.

33. The process of claim 32 wherein the amount of said distillate hydrocarbon material added is from about 15 to about 30 parts for each 100 parts of fresh coker feed.

34. The process of claim 33 wherein said coker feedstock is a resid having an API gravity of less than 10 and a sulfur content of more than 2.0 percent by weight.

* * * * *